US007699239B2

(12) United States Patent
Brown et al.

(10) Patent No.: US 7,699,239 B2
(45) Date of Patent: Apr. 20, 2010

(54) RETRO-REFLECTIVE SYSTEM FOR INCREASING SAFETY OF A RAILROAD CROSSING, AND ASSOCIATED METHOD

(75) Inventors: Curt M. Brown, Boulder, CO (US); Doug Delmonico, Arvada, CO (US)

(73) Assignee: Crossing Guard LLC, Broomfield, CO (US)

( * ) Notice: Subject to any disclaimer, the term of this patent is extended or adjusted under 35 U.S.C. 154(b) by 982 days.

(21) Appl. No.: 11/312,905

(22) Filed: Dec. 20, 2005

(65) Prior Publication Data

US 2006/0157577 A1 Jul. 20, 2006

Related U.S. Application Data

(60) Provisional application No. 60/637,624, filed on Dec. 20, 2004.

(51) Int. Cl.
*E01B 21/00* (2006.01)
*E01F 9/06* (2006.01)

(52) U.S. Cl. ..... 238/8; 404/14

(58) Field of Classification Search ..... 238/2, 238/3, 5, 8, 9; 404/14, 93, 94
See application file for complete search history.

(56) References Cited

U.S. PATENT DOCUMENTS

| | | | | |
|---|---|---|---|---|
| 4,020,211 | A * | 4/1977 | Eigenmann | 428/323 |
| 6,051,297 | A * | 4/2000 | Maier et al. | 428/56 |
| 6,247,872 | B1 * | 6/2001 | Marcato | 404/94 |
| 6,726,116 | B2 * | 4/2004 | Hofstetter, Sr. | 238/8 |

OTHER PUBLICATIONS

Canadian Application No. 2,530,751, Office Action dated Nov. 10, 2008, 2 pages.
Canadian Application No. 2,530,751, Response to Office Action dated May 11, 2009, 12 pages.
Notice of Allowance issued in related Canadian Patent Application Serial No. 2530751, filed Dec. 19, 2005, dated Sep. 14, 2009, 1 page.

* cited by examiner

*Primary Examiner*—S. Joseph Morano
*Assistant Examiner*—Robert J McCarry, Jr.
(74) *Attorney, Agent, or Firm*—Lathrop & Gage LLP

(57) ABSTRACT

A retro-reflective system for increasing the safety of a railroad crossing includes at least one railroad crossing panel. A sealer is applied to a prepared surface of the railroad crossing panel. An adhesive applied over the sealer after the sealer is partially cured adheres a retro-reflective material thereto. The retro-reflective material increases visibility of the railroad crossing. Anti-skid elements may also be applied over the adhesive, to provide enhanced traction for vehicles or pedestrians traversing the railroad crossing.

11 Claims, 3 Drawing Sheets

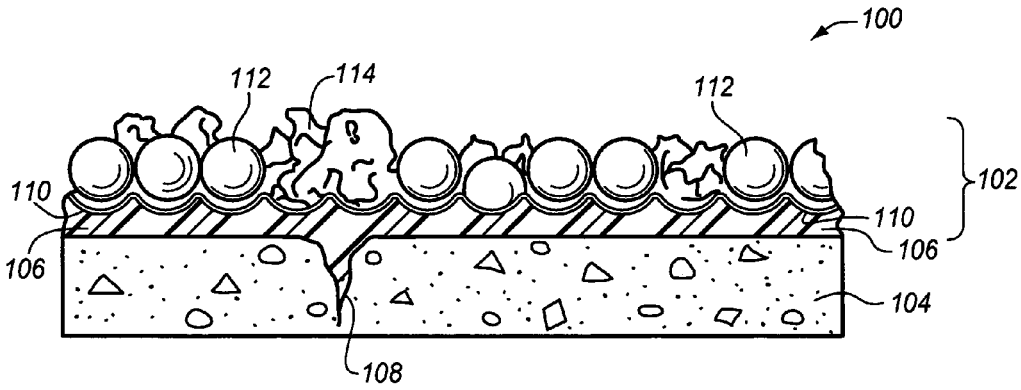
FIG. 1
FIG. 2
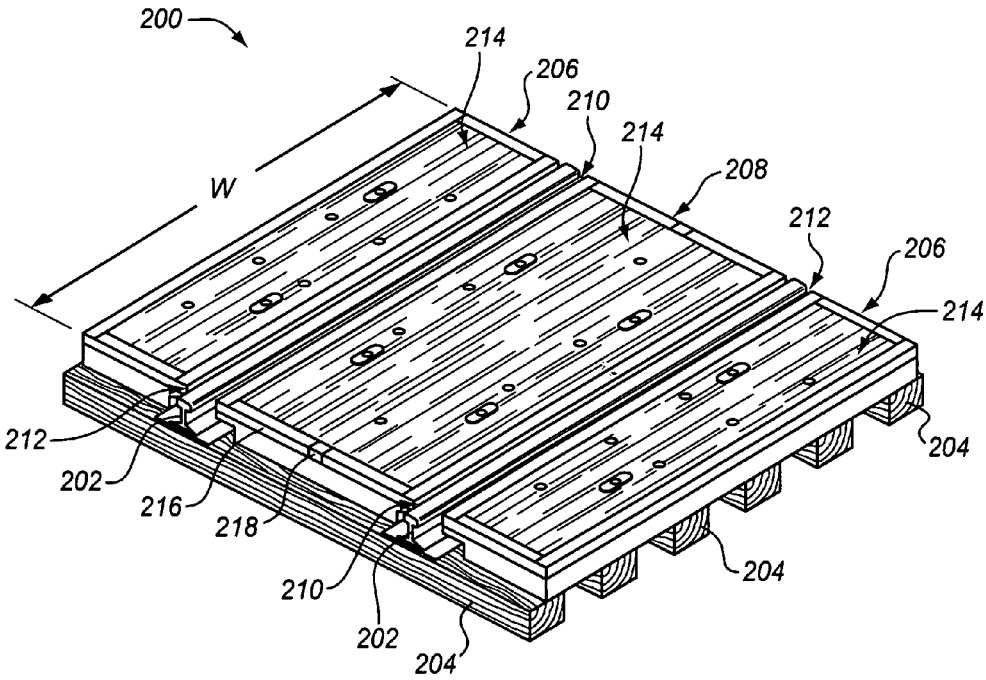

400
START
PREPARE SURFACE
402
PREPARE SEALER
404
APPLY SEALER TO SURFACE
406
ALLOW SEALER TO PARTIALLY CURE
408
APPLY ADHESIVE TO SURFACE OF SEALER
410
412
REFLECTIVE?
YES
414
APPLY RETRO-REFLECTIVE ELEMENTS TO SURFACE OF SEALER
NO
416
REFLECTIVE?
418
APPLY NON-SLIP ELEMENTS TO SURFACE OF SEALER
NO
ALLOW SEALER TO CURE
420
END

RETRO-REFLECTIVE SYSTEM FOR INCREASING SAFETY OF A RAILROAD CROSSING, AND ASSOCIATED METHOD

RELATED APPLICATION

This application claims priority to U.S. Provisional Patent Application No. 60/637,624, filed Dec. 20, 2004 which is incorporated herein by reference.

BACKGROUND

The United States has approximately 268,000 highway-rail and pedestrian crossings. Despite prior art preventive measures such as traffic lights, stop lights, rail crossing lights, railroad gates and signs, on average, more people die at highway-rail crossings than in commercial airline crashes. Oftentimes, the cause of a highway-rail or pedestrian crossing accident is that the driver fails to pay attention to highway conditions and markings. For example, drivers may fail to note traffic signals because of their location on the side of the road or because the signals are difficult to see in fog or darkness. Drivers may also misjudge highway conditions, for example braking too late in slippery conditions, only to slide into the railroad crossing. Under such slippery conditions, it may be difficult for the driver to drive off of the tracks.

SUMMARY

In one embodiment, a retro-reflective railroad crossing provides a non-skid, safety marking that may be seen by approaching drivers. The crossing includes a penetrating sealer and reflective material. The penetrating sealer may operate to repair concrete substrate of the crossing. An adhesive may be used with the reflective material. Following partial cure of the penetrating sealer, the reflective material is applied with non-skid and/or retro-reflective optical elements broadcast onto the surface.

In one embodiment, a method for increasing safety of a railroad crossing includes preparing one or more surfaces of the railroad crossing; applying a sealer to the surface; partially curing the sealer, and applying an adhesive to the partially cured sealer. One or more non-skid and/or retro-reflective elements are added to the adhesive, and the sealer and adhesive are allowed to cure.

In one embodiment, a retro-reflective system for increasing the safety of a railroad crossing includes at least one railroad crossing panel; a sealer applied to a surface of the railroad panel; an adhesive applied to the sealer, and a retro-reflective material applied to the adhesive.

BRIEF DESCRIPTION OF THE FIGURES

FIG. 1 is a cross-sectional view of a retro-reflective system for increasing safety of a railroad crossing.

FIG. 2 depicts a railroad crossing with field panels and other surfaces suitable for application of the retro-reflective system of FIG. 1.

DETAILED DESCRIPTION OF THE FIGURES

Figure 3:
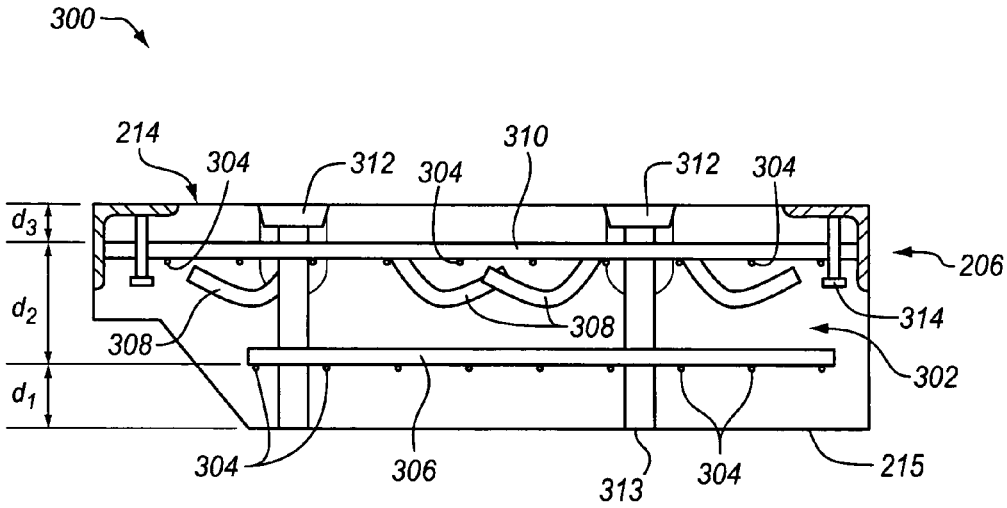
FIG. 3 is a cross-sectional view of the field panel of FIG. 2.

A retro-reflective system for increasing safety of a railroad crossing, described below, may include concrete sealing components and pavement markings that include optical elements and/or skid resistant material. Accordingly, pavement markings with retro-reflective and anti-skid properties may be used in conjunction with materials to repair worn surface areas on concrete and enhance safe operations in hazardous areas, to create a safer operating environment for school crossings, rail crossings, dangerous road crossings and other hazardous areas, through a procedure which can be applied during normal maintenance operations. The procedure may include OEM manufacturing of railroad crossings which incorporate these markings for improved safety awareness and provide a more durable concrete product.

FIG. 1 shows one exemplary cross-section of a system 100 for increasing the safety of a railroad crossing. In one embodiment system 100 is a retro-reflective railroad crossing 100. A retro-reflective material 102 adheres to a surface 104, which is, for example, part of concrete material that forms the railroad crossing (see, e.g., railroad crossing 200, FIG. 2).

To form material 102, a sealer 106 (e.g., a concrete sealer, repair material, epoxy or urethane) is prepared and applied to the surface 104, and allowed to partially cure. Sealer 106 is for example a penetrating sealer that repairs the concrete to which it is applied. For example, sealer 106 may fill a crack 108 to seal and improve worn rail, crossing and/or crosswalk areas of the retro-reflective railroad crossing 100. Sealer may also condition the surface 104 to provide improved strength and durability. Conditioning of the surface also provides for improved strength and durability of concrete crossing areas.

An adhesive 110 is applied to the surface of partially-cured sealer 106, and one or more of retro-reflective elements 112 (e.g., glass beads) and anti-skid elements 114 (e.g., abrasive materials such as sand) are applied. With retro-reflective elements 112, material 102 may form a quasi-Lambertian surface, whereby at least part of light energy that illuminates elements 112 will reflect back towards the source. For example, light from car headlights striking surface 102 will reflect back towards the driver of the car. Retro-reflective elements 112 and/or anti-skid elements 114 may provide a safety marking that may be seen by approaching drivers. For example, elements 112 and/or 114 may form a symbol, or words such as "Railroad Crossing", "RR X-ing" and the like. Retro-reflective articles of this construction may provide improved crossing safety and driver awareness at railroad crossings as well as seal and improve worn rail and crosswalk areas. For example, a driver whose attention is focused on a road may miss railroad crossing signs posted on the roadside, but note the retro-reflective railroad crossing.

Adhesive 110 is for example a highly reflective epoxy paint, such as a white reflective epoxy paint that is applied to the crossing after sealer 106. Reflective elements 112 may be high-compression reflectorized glass beads 112 that are broadcast into the reflective epoxy paint to provide greater visibility. Reflective elements 112 may provide the anti-skid feature, such that additional anti-skid elements 114 are not needed. For example, high-compression reflectorized glass beads 112 may serve as both reflective and anti-skid elements.

FIG. 2 shows an exemplary railroad crossing 200. Crossing 200 is shown with two railroad tracks 202 overlying railroad ties 204, which are typically about ten feet long and which may be spaced at 19½ inch centers. Field panels 206 and a gage panel 208 overlie ties 204. Surfaces 214 of field and gage panels 206, 208 may be flush with a top surface of tracks 202, and may also be flush with pavement leading up to tracks, to allow vehicles to cross railroad tracks 202 with minimal bumping. Accordingly, gaps 210 may allow flanges of train wheels to run along tracks 202 without interference by gage panel 208 disposed flush with the tracks. Gaps 210 may be sized with a depth and width sufficient to provide clearance for train wheels even when debris, ice and/or snow falls into gaps 212. Gaps 210 may likewise be formed as angled troughs so that precipitation and/or debris in gaps 210 is diverted to one or both sides of railroad crossing 200. To further reduce bumping, field and gage panels 206,208 and tracks 202 may also be level with pavement leading up to crossing 200.

Gaps 212, disposed between tracks 202 and field panels 208, provide spacing between tracks 202 and concrete or another material forming field panels 208. This may prevent damage to tracks 202 by the field panel material and/or deposition of any loose field panel material on tracks 202. Gaps 212 may also provide a repository for surface materials such as gravel, ice, snow and/or debris disposed upon field panels 208, to reduce the deposition of such materials on tracks 202. Gaps 212 may additionally provide drainage, for example to minimize precipitation accumulation and subsequent ice formation upon surfaces 214. Accordingly, gaps 212 may be formed as angled troughs, for shuttling precipitation and/or debris that falls within gaps 212 to one or both sides of the railroad crossing. Both gaps 210, 212 may be sized to accommodate shrinking and swelling of railroad crossing components due to changes in weather and temperature.

In an illustrative embodiment, field and gage panels 206, 208 have a width (W) of about 8½ feet. They may be replaceable panels formed with a frame 216. Frame 216 is for example a steel frame made with about three inch channel steel, with frame spacers 218 providing space for expansion of frame 216 due to temperature changes. Frame spacer 218 may be an expansion joint.

Surfaces 214 are suitable for application of the railroad crossing retro-reflective material 102 of system 100. Surfaces 214 may be coated (e.g., using process 400, FIG. 4) with retro-reflective material 102, improving both night-time visibility of railroad crossing 200 and traction of surface 214, and thereby also improving the safety of railroad crossing 200. For example, a motorist may identify railroad crossing 200 earlier and more easily when crossing 200 includes retro-reflective material 102. Retro-reflective crossing 200 may be seen when vehicle headlights strike retro-reflective material 102 from a distance, as opposed to a non-reflective crossing which may not be identified until fully illuminated by the headlights, or may not be identified at all. Anti-skid elements 114 provide enhanced traction between vehicle tires and retro-reflective crossing 200, allowing the vehicle to more easily traverse retro-reflective crossing 200, particularly when the crossing is wet or icy. In addition, should lack of attention or extreme weather conditions (such as dense fog) prevent a driver from visually noting retro-reflective crossing 200, anti-skid elements 114 may warn drivers of the railroad crossing. For example, anti-skid elements 114 may function in the manner of highway rumble strips, providing an audible warning and/or a physical vibration to alert drivers that they are entering a railroad crossing.

Railroad crossing retro-reflective material 102 may be applied during manufacture of a field or gage panel, or material 102 may be applied to existing railroad crossings, for example during maintenance of the crossing. System 100 may thus provide cost-effective repair and safety enhancement of an existing crossing at reduced down-time and manpower. For example, sealer 106 may repair and condition panels of an existing crossing to provide a strong, resilient surface, while retro-reflective and/or anti-skid elements 112, 114 provide increased visibility and traction. While repair of existing railroad crossings may be held to standard operating procedures, system 100 may be employed to increase driver and pedestrian safety.

FIG. 3 shows a cross-section 300 through field panel 206 of FIG. 2. Field panel 206 may include structural elements such as wires 304 for hanging lower rebar 306, bent rebar anchors 308 and upper rebar 310. As shown in cross-section 300, the distance (d1) between lower rebar 306 and a base 215 of field panel 206 may be about one-half the distance (d2) between upper and lower rebar 310, 306, while the distance (d3) between upper rebar 310 and surface 214 may be about one-third d2.

In an illustrative embodiment, a concrete material 302 fills field panel 206. Concrete material 302 may have retro-reflective material 106 applied to surface 214 during manufacture. Field panel 206 may be filled with a concrete polymer resin such that adhesive 110, retro-reflective elements 112 and anti-skid elements 114 may be applied directly to field panel 206. Channels 313 through field panel 206 allow for anchoring to railroad ties, e.g., ties 204, for example with drive spikes 312. Stud anchors 314, which may for example be impact-expansion or wedge-expansion type concrete anchors, secure frame 216 around field panel 206.

Figure 4:
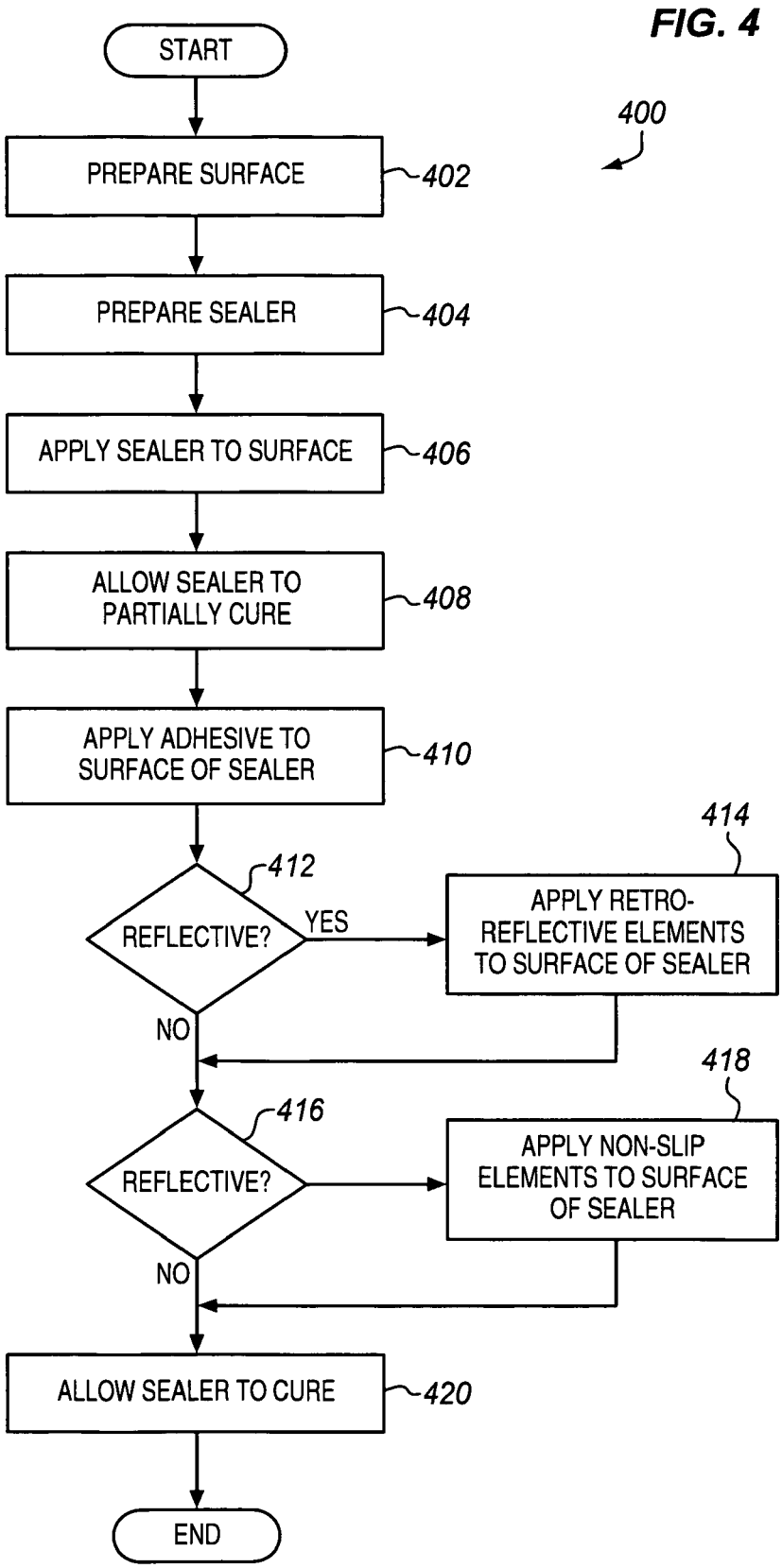
FIG. 4 is a flowchart illustrating a method for applying the retro-reflective system of FIG. 1 to field and gage panels of a railroad crossing.

FIG. 4 is a flowchart illustrating one exemplary process 400 for applying retro-reflective material 102 to surfaces (e.g. surfaces 104, 214) of field and gage panels 206, 208. In step 402, the surface is prepared so that it is ready for application of retro-reflective material 102. In one example of step 402, surfaces 114 of railroad crossing 200 are cleaned to remove dirt and grease. In step 404, a sealer is prepared. In one example of step 404, a resin compound is mixed for use as sealer 106. In step 406, the sealer is applied to the surface prepared in step 402. In one example of step 406, sealer 106 is applied to surface 114. In step 408, the sealer is allowed to partially cure. In one example of step 408, sealer 106 is a two-part resin compound that is allowed to partially cure. In another example of step 408, sealer 106 is a compound that is allowed to partially dry. In step 410, an adhesive such as adhesive 110 is applied to the surface of the partially cured sealer. As noted with respect to FIG. 1, adhesive 110 may be a highly reflective epoxy paint.

Step 412 is a decision. If the finished surface it to be reflective, retro-reflective elements, e.g., retro-reflective elements 112, are applied to the surface of the sealer, in step 414. Retro-reflective elements may, for example, be glass beads or high compression reflectorized glass beads. If the finished surface is not to be reflective, a determination is made as to whether the finished surface is to be non-skid, decision 416.

If the finished surface is to be non-skid, non-slip elements such as anti-skid elements 114 are applied to the surface of the sealer, in step 418. As appreciated, retro-reflective elements 112 may provide anti-skid properties, such that additional anti-skid elements are not used. Where both retro-reflective and anti-skid elements 112, 114 are applied, both elements 112, 114 may be applied to adhesive 110. Further, these elements may be applied in any order. In one embodiment, where both elements 112 and 114 are to be applied, elements 112 and 114 are pre-mixed and applied to adhesive 110 simultaneously.

If the finished surface is not to be non-skid (decision 416), the sealer and adhesive are allowed to cure, in step 420. In one example of step 420, sealer 106 and adhesive 110 are allowed to cure such that no damage is incurred from use.

Changes may be made in the above systems and methods without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. A method for increasing safety of a railroad crossing, comprising:

preparing one or more surfaces of the railroad crossing;

applying a sealer to the surface;

partially curing the sealer;

applying an adhesive to the partially cured sealer;

applying one or more elements to the adhesive; and allowing the sealer and adhesive to cure.

2. The method of claim 1, wherein the elements comprise retro-reflective elements.

3. The method of claim 2, wherein the retro-reflective elements comprise glass beads.

4. The method of claim 1, wherein the elements comprise anti-skid elements.

5. The method of claim 1, wherein the anti-skid elements comprise an abrasive material.

6. The method of claim 1, wherein the sealer comprises a polymer-concrete.

7. The method of claim 1, wherein the sealer comprises an epoxy resin.

8. The method of claim 1, wherein the sealer comprises urethane.

9. The method of claim 1, wherein the surface is a top surface of a field panel.

10. The method of claim 1, wherein the surface is a top surface of a gage panel.

11. The method of claim 1, wherein the steps of preparing and applying the sealer repair damage to the surface.

* * * * *